United States Patent [19]

Cummins et al.

[11] 4,220,143

[45] Sep. 2, 1980

[54] THERAPEUTIC APPARATUS

[76] Inventors: James M. Cummins, 3334 Parker; Gilbert E. Pierfelice, 25130 Marshall, both of Dearborn, Mich. 48124

[21] Appl. No.: 892,393

[22] Filed: Mar. 31, 1978

[51] Int. Cl.[3] ..... A61H 1/00

[52] U.S. Cl. ..... 128/33; 5/108

[58] Field of Search ..... 128/24 R, 33, 49, 28; 5/60, 108

[56] References Cited

U.S. PATENT DOCUMENTS

| | | | |
|---|---|---|---|
| 2,467,724 | 4/1949 | Baron | 128/33 X |
| 2,700,382 | 1/1955 | Brand | 128/33 |
| 3,373,738 | 3/1968 | Wittke | 128/28 |
| 3,392,723 | 7/1968 | Calvin | 128/24 R |

*Primary Examiner*—Lawrence W. Trapp

*Attorney, Agent, or Firm*—Barnes, Kisselle, Raisch & Choate

[57] ABSTRACT

A therapeutic apparatus for the prevention of ischemic ulcers and treatment for the soreness and stiffness of joints of patients suffering from arthritis, Parkinson's disease and the like. In the apparatus a patient rests on a surface such as that provided by a conventional mattress and bed which surface is oscillated through an included angle in the range of about 2 to 6 degrees in a generally vertical plane extending generally parallel to the longitude of the patient at a rate of about 15 to 150 seconds per each sweep through the included angle.

11 Claims, 5 Drawing Figures

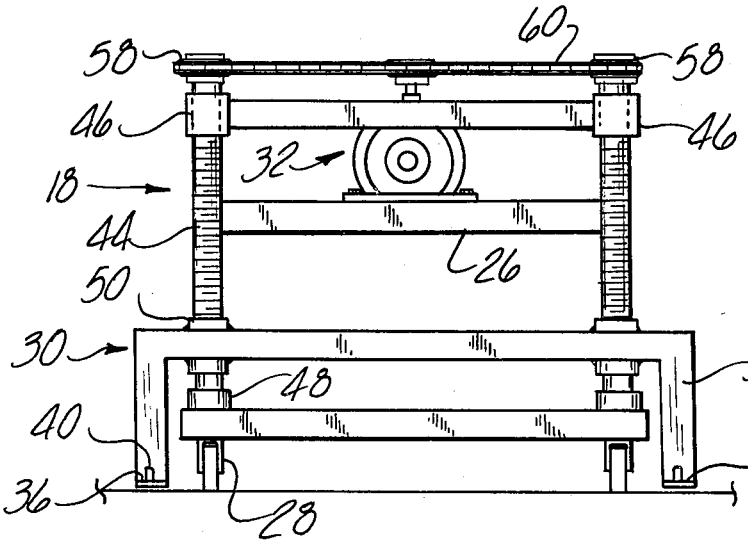
Fig-3
Fig-5
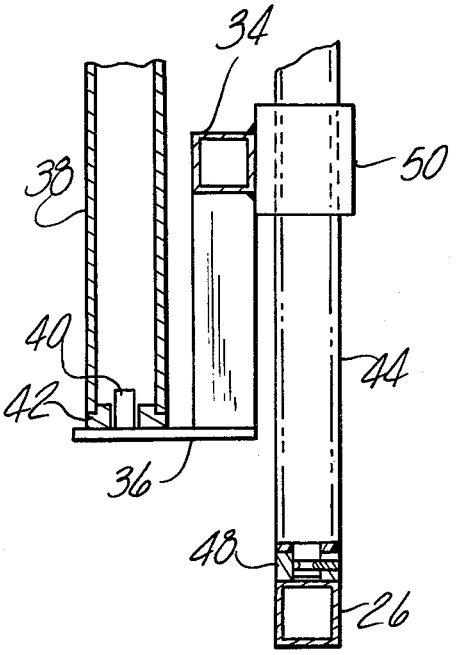
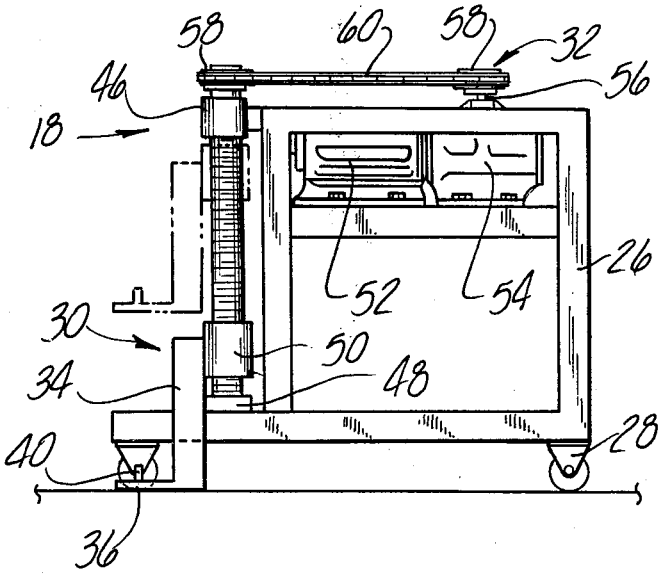
Fig-4

THERAPEUTIC APPARATUS

This invention relates to a therapeutic treatment and more particularly to a method and apparatus for prevention of ischemic ulcers and for decreasing and in some instances eliminating the soreness and stiffness of joints of persons having arthritis, Parkinson's Disease, and similar ailments.

A serious complication which develops with patients who remain in one position for a prolonged period of time whether sitting or reclining is the development of ischemic ulcers. Such ulcers, commonly referred to as bedsores, are caused by localized areas of skin and subcutaneous tissue being subjected to sufficient pressure to obstruct the inflow of arterial blood thereto resulting in anemia and necrosis of such skin and tissue. Such ulcers are most likely to occur in the areas of the body having weight bearing bony prominences that are covered only by skin with little muscle and subcutaneous tissue therebetween, such as the heels, knees, pelvis, coccyx, spine, shoulder blades, elbows and head.

Ischemic ulcers can lead to sepsis, osteomyelitis, mutiliating amputations, and even death. Thus, such ulcers debilitate the patient, substantially prolong hospitalization, and interfere with rehabilitation. It has been estimated that such ulcers increase the cost of a patients hospital and medical care by $2,000 to $10,000.

Prior approaches for the prevention of ischemic ulcers have included ideal nursing care by maintaining scrupulous hygiene and care of the skin and avoidance of prolonged pressure on the same localized areas of the skin by turning the patient frequently and utilizing various flotation devices. Prior flotation devices for decreasing the pressure to which the skin is subjected include small pads of a gel material almost identical to that of human fat tissue contained in a highly elastic membrane covering, waterbeds, and water mattresses. Such flotation devices are expensive, subject to rupture, puncture and leakage, and increase the difficulty in providing adequate nursing care for the patient. Moreover, waterbeds and water mattresses are heavy, difficult to transfer from one bed to another, and for some patients the floating sensation produced by such devices is uncomfortable.

The bodily movement while resting or sleeping of persons having arthritis, Parkinson's disease, and the like is restricted which is believed to result in the stiffness and soreness of the joints and bony prominences of such persons. Conventional treatment for such soreness and stiffness includes medication to relieve the aches and pain and frequent manual turning or movement of the person's body which interrupts resting and sleeping and usually requires increased nursing care.

Objects, features and advantages of this invention are to provide an apparatus which can be utilized with a conventional bed and mattress for the prevention of ischemic ulcers and lesions of a person who remains in one position on the mattress for a prolonged period of time, to decrease and in some cases eliminate the soreness and stiffness of joints and bony prominences of persons suffering from Parkinson's disease, arthritis and the like, to improve the circulation, mental alertness, and physical activity of infirm and bed ridden patients, and to facilitate and decrease the cost of nursing care.

In accordance with the method of this invention a patient resting on a surface such as that provided by a conventional mattress and bed is subjected to a gentle rocking or oscillating action by moving the mattress up and down in an arc through an included angle in a generally vertical plane extending generally longitudinally of the patient and the mattress in the range of about 2 to 6 degrees and preferably about 3½ to 4½ degrees. The mattress is swept through the included angle at a rate in the range of about 15 to 150 seconds per traverse and preferably about 45 to 90 seconds per traverse in one direction through the included angle. Preferably, although not necessarily, the mattress is in a generally horizontal plane so that at one end of its traverse through the included angle the head of the patient resting thereon is elevated above his feet and at the other end of the traverse his feet are elevated above his head. Preferably, although not necessarily, a pause in the range of 10 to 45 seconds and preferably about 30 seconds is provided at each end of the traverse of the mattress through the included angle.

It is theorized that this gentle rocking motion of the mattress imparts a massaging action to a patient laying thereon which shifts or slightly moves the patient's outer skin relative to the patient's skeleton and thereby shifts and changes the points at which pressure is applied to the body of the patient which prevents any localized area of the patient's skin from being continuously subjected to sufficient pressure to prevent an adequate flow or circulation of blood to the skin and any subcutaneous tissues of such localized area thereby preventing formation of ischemic ulcers and decreasing and in some instances eliminating the stiffness and soreness of joints. The alternate elevation of the head and feet of the patient and the pause at each end of the sweep of the mattress through the included angle is also believed to further enhance circulation of the patient's blood.

Regardless of the theoretical explanation, in practice such gentle rocking action of the mattress has proved to be very effective in eliminating the soreness and stiffness in the bony prominences of patients suffering from Parkinson's disease, arthritis and the like, and in the prevention of ischemic ulcers and lesions of patients who normally remain in one position for prolonged periods of time when reclining, resting or sleeping. Moreover, in practice such gentle rocking action does not inhibit and in many instances induces patients to sleep.

A suitable apparatus for carrying out this invention is shown in the accompanying drawings in which:

FIGS. 3 and 4 are front and side views respectively of the oscillating device of FIG. 1 with the cover removed.

FIG. 5 is an enlarged fragmentary side view partially in section of the connection of the lifting yoke of the device of FIG. 1 with the posts of the head end of the hospital bed.

Figure 1:
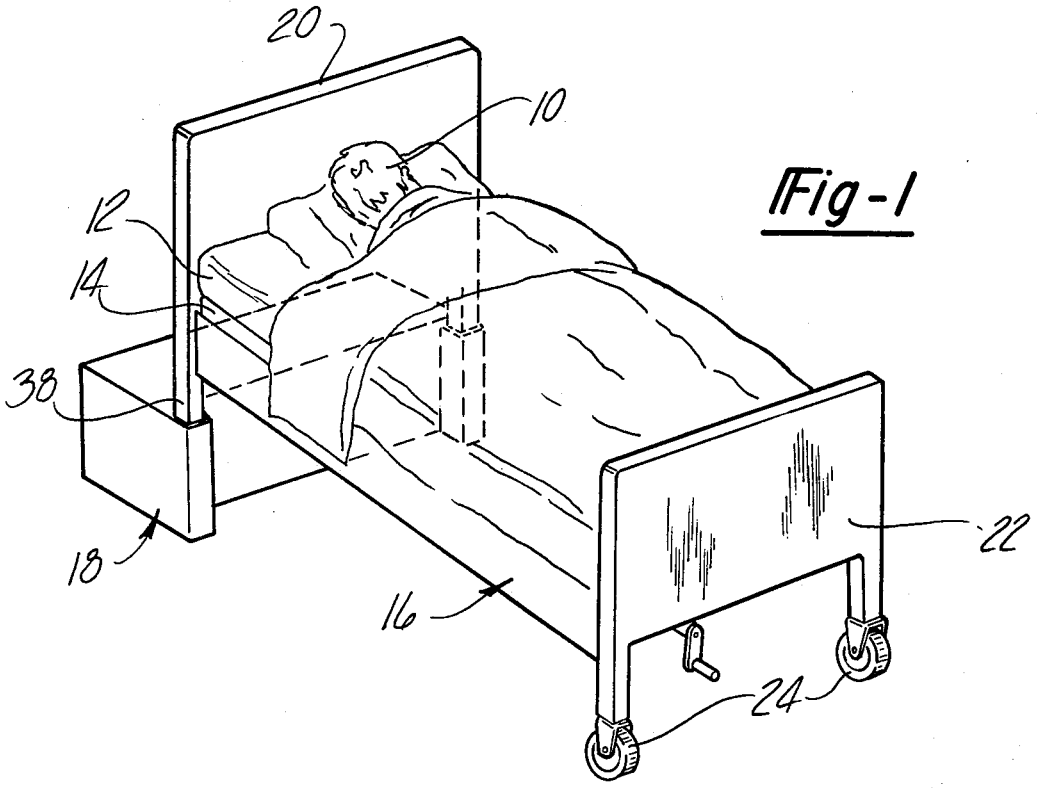
FIG. 1 is a perspective view of a patient lying on a conventional mattress and hospital bed which is connected to an oscillating device adapted to carry out this invention.

Referring in more detail to the drawings, as shown in FIG. 1, applicant's process may be carried out on a patient 10 reclining on a conventional mattress 12 and inner springs 14 of a conventional hospital bed 16 by an oscillating device 18. One end of bed 16 such as the headboard 20 is carried by oscillating device 18 and the other end of the bed such as footboard 22 preferably has wheels or casters 24 on the bottom thereof to provide a pivot point about which the bed is oscillated in an arc by device 18.

Figure 2:
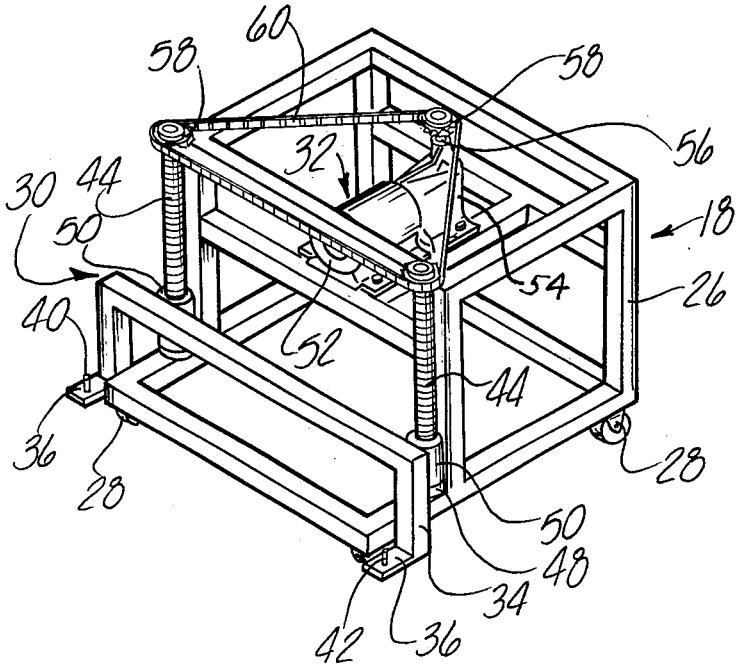
FIG. 2 is a perspective view of the oscillating device of FIG. 1 with the cover removed.

As shown in FIGS. 2 through 4 oscillator device 18 has a frame 26 of tubular steel carried by four casters 28 secured to the bottom thereof. Bed 16 is oscillated by a lift assembly 30 operated by a drive assembly 32 both of which are secured to frame 26. Lift assembly 30 has a carrier yoke 34 with a pair of lift forks 36 fixed thereto which are adapted to underlie and carry the posts 38 of the headboard 20 of bed 16. As shown in FIG. 5 each post 38 is retained on a lift fork 36 by a locator pin 40 which is fixed to the fork and projects into a caster socket 42 in the end of tubular post 38. Yoke 34 and hence one end of bed 16 is alternately raised and lowered by a pair of drive members 44 mounted for rotation on frame 26 by bearings 46 and 48 and each having a traveler 50 fixed to yoke 34.

Members 44 are rotated by drive assembly 32 which has an electric motor 52 connected to a gear reducer 54, the output shaft 56 of which is connected to members 42 by sprockets 58 and a timing chain 60 to syncronize the movement of members 44. Members 44 may be either bidirectional helical cams or ball screws such as the ball screws commercially available from the Saginaw Steering Gear Division of General Motors Corporation in Saginaw, Michigan. If members 44 are bidirectional helical cams they may be rotated continuously in one direction by drive assembly 32 to both raise and lower lifting yoke 30. However, if members 44 are ball screws they must be alternately rotated in opposite directions to raise and lower carrier yoke 34. The rotation of ball screws in opposite directions may be accomplished by utilizing a direct current motor 52 and a suitable timer and control circuit (not shown) for reversing the direction of rotation of the direct current motor.

If it is desired to provide a short pause at each end of the up and down movement of yoke 34 the control circuit for the direct current motor 52 utilized with the ball screw members 42 can include an appropriate relay or other timer for turning off the motor to provide such pause. If members 42 are bidirectional helical cams this pause at each end of the travel of yoke 34 can be provided by a suitable design of the helical cams so that yoke 34 remains momentarily at least substantially stationary at each end of its travel while the members 42 continue to rotate and thus such pause occurs even though the cam members 42 are continuously rotated in one direction by the drive assembly 32.

In practice an oscillating device 18 which substantially continuously alternately raises and lowers a lifting yoke 30 connected to one end of a hospital bed through a generally vertical traverse of about 5¼ inches at the rate of one traverse per 60 seconds has proved to be highly satisfactory to oscillate a conventional hospital bed about 7 feet in length through an arc of about 3½ degrees at the rate of about two minutes per complete cycle of raising and lowering the bed.

It has been found that utilization of this device with a conventional hospital bed and mattress prevents the formation of ischemic ulcers of patients who remain in such a bed for prolonged periods of time and decreases the soreness and stiffness of the joints of persons suffering from Parkinson's disease and the like. Since the oscillating device can be used with a conventional mattress and bed without modification thereof, it eliminates the need for special flotation pads and water mattresses in preventing ischemic ulcers and facilitates and simplifies the nursing care of patients who remain in one position for prolonged periods of time.

I claim:

1. A machine for imparting an oscillating motion to a bed and the body of a patient who remains in essentially one position for a prolonged period of time on a generally horizontally extending surface of the bed which underlies the body of the patient and supports the weight thereof by bearing on portions of the skin of the patient, the machine comprising a frame, lift means carried by said frame and constructed and arranged to engage one end of the bed for alternately raising and lowering such one end of the bed to impart an oscillatory movement thereto, and drive means including at least one lead screw operably associated with said lift means for reciprocating generally vertically said lift means to sweep such bed through an included angle of about 2 to 6 degrees in a generally vertical plane generally parallel to the longitude of such bed at a rate of about 15 to 150 seconds per sweep in one direction through said included angle.

2. The machine of claim 1 wherein said generally horizontally extending surface and said body bearing thereon is swept back and forth through said included angle at least substantially continuously.

3. The machine of claim 1 wherein said included angle is in the range of 3½ to 4½ degrees.

4. The machine of claim 1 wherein said generally horizontally extending surface and said body bearing thereon is swept through said included angle at the rate of about 45 to 90 seconds per sweep in one direction through said included angle.

5. The machine of claim 1 wherein said generally horizontally extending surface pauses and remains at least substantially immovable at each end of its sweep through said included angle for a period of time in the range of about10 to 45 seconds.

6. The machine of claim 1 wherein at one end of the sweep of said generally horizontally extending surface through said included angle the head of the body bearing thereon is elevated above the feet thereof and at the other end of its sweep through said included angle the feet of said body bearing thereon are elevated above the head thereof.

7. The machine of claim 6 wherein at each end of the sweep of said generally horizontally extending surface through such included angle, such surface pauses and remains at least substantially immovable for at least about 10 seconds.

8. The method of claim 6 wherein at each end of the sweep of said support surface through said included angle said support surface pauses and remains at least substantially immovable for a period of time in the range of about 10 to 45 seconds.

9. The device of claim 1 wherein said lead screw comprises a bi-directional helical cam for raising and lowering said lift means generally vertically.

10. The machine of claim 1 wherein said lead screw comprises a ball screw for raising and lowering said lift means generally vertically.

11. The machine of claim 1 wherein said drive means comprises an electric motor and a pair of ball screws synchronously driven by said motor to raise and lower said lift means generally vertically.

* * * * *

UNITED STATES PATENT AND TRADEMARK OFFICE

CERTIFICATE OF CORRECTION

PATENT NO. : 4,220,143

DATED : September 2, 1980

INVENTOR(S) : James M. Cummins & Gilbert E. Pierfelice

It is certified that error appears in the above-identified patent and that said Letters Patent are hereby corrected as shown below:

In column 1, line 5 after "to", delete "a method and" and insert -- an --.

In column 1, line 66, after "with", delete "the method of".

Signed and Sealed this

*Twenty-fifth* Day of *November 1980*

[SEAL]

*Attest:*

SIDNEY A. DIAMOND

*Attesting Officer*

*Commissioner of Patents and Trademarks*